US008410696B2

(12) United States Patent
Lee et al.

(10) Patent No.: US 8,410,696 B2
(45) Date of Patent: Apr. 2, 2013

(54) PLASMA DISPLAY PANEL FOR MULTI-SCREEN AND FABRICATING METHOD FOR THE SAME

(75) Inventors: Jae-Yeol Lee, Daegu (KR); Hae-Sung Jang, Daegu (KR)

(73) Assignee: Orion Co. Ltd., Gyeongsangbuk-Do (KR)

( * ) Notice: Subject to any disclaimer, the term of this patent is extended or adjusted under 35 U.S.C. 154(b) by 103 days.

(21) Appl. No.: 12/595,876

(22) PCT Filed: Apr. 16, 2008

(86) PCT No.: PCT/KR2008/002146

§ 371 (c)(1),
(2), (4) Date: Oct. 14, 2009

(87) PCT Pub. No.: WO2008/130128

PCT Pub. Date: Oct. 30, 2008

(65) Prior Publication Data

US 2010/0072871 A1 Mar. 25, 2010

(30) Foreign Application Priority Data

Apr. 20, 2007 (KR) ..... 10-2007-0038817

(51) Int. Cl.
*H01J 17/49* (2012.01)

(52) U.S. Cl. ..... 313/587; 313/582

(58) Field of Classification Search ..... 313/1, 581–589
See application file for complete search history.

(56) References Cited

U.S. PATENT DOCUMENTS

2004/0119397 A1* 6/2004 Sakamoto ..... 313/495
2008/0018247 A1* 1/2008 Park et al. ..... 313/582

FOREIGN PATENT DOCUMENTS

JP 1997-507958 A 8/1997
JP 2002-050289 A 2/2002
JP 2004-146211 A 5/2004
KR 10-2003-0025408 A 3/2003

OTHER PUBLICATIONS

International Search Report corresponding to International Patent Application No. PCT/KR2008/002146, dated Aug. 26, 2008.
Office Action dated Aug. 20, 2010 in counterpart Chinese application No. 200880012460.9.

* cited by examiner

*Primary Examiner* — Anh Mai
*Assistant Examiner* — Brenitra M Lee
(74) *Attorney, Agent, or Firm* — Ohlandt, Greeley, Ruggiero & Perle, L.L.P.

(57) ABSTRACT

There are provided a plasma display panel (PDP) wherein a seam area is minimized, so that continuity of screens can be stably ensured, and a method of fabricating the same. In the PDP formed by assembling a plurality of unit PDPs, each of the unit PDPs includes front and rear substrates; a sealant formed on the side surfaces of the front and rear substrates; side electrodes formed on the sealant; and functional layers formed on the rear surface of the rear substrate and the side surfaces of the front and rear substrates.

3 Claims, 11 Drawing Sheets

PLASMA DISPLAY PANEL FOR MULTI-SCREEN AND FABRICATING METHOD FOR THE SAME

CROSS-REFERENCE TO RELATED APPLICATION

This application claims priority to PCT Application No. PCT/KR2008/002146 filed on 2008 Apr. 16 and Korean Patent Application No. 10-2007-0038817 filed on 2007 Apr. 20, and all the benefits accruing therefrom under 35 U.S.C. §119, the contents of which in its entirety are herein incorporated by reference.

BACKGROUND

1. Field

The present invention relates to a multi plasma display panel (PDP) and a method of fabricating the same, and more particularly, to a multi PDP wherein a seam area is minimized, so that continuity of screens can be stably ensured, and a method of fabricating the same.

2. Description of the Related Art

Display devices are becoming larger in size, and the plasma display panel (PDP) is no exception in that regard. However, there is a limit in increasing the size of a PDP using only one glass substrate. Therefore, recently, a multi plasma display panel has appeared, in which PDPs with a predetermined size are assembled continuously.

Such a multi PDP has an advantage in that the display area of the multi PDP are extended, and respective PDPs can be controlled individually to display different screens.

However, as the multi PDP is configured by assembling several PDPs, no image is formed at the joint between the PDPs, i.e., a seam area, and therefore, continuity of screens may be degraded.

SUMMARY

The present invention has been conceived to solve the aforementioned problems. Accordingly, an object of the present invention is to provide a PDP wherein a seam area is minimized, so that continuity of screens can be stably ensured, and a method of fabricating the same.

According to an aspect of the present invention, there is provided a PDP, includes: front and rear substrates; a sealant formed on side surfaces of the front and rear substrates; side electrodes formed on the sealant; and functional layers formed on the rear surface of the rear substrate and the side surfaces of the front and rear substrates.

According to another aspect of the present invention, there is provided a method of fabricating a PDP includes the steps of: stacking and laminating front and rear substrates together and forming a sealant on side surfaces of the front and rear substrates; sealing front and rear substrates together by the sealant; polishing the sealant; forming side electrodes on the sealant; forming a moisture proof layer on the rear surface of the rear substrate and the side surfaces of the front and rear substrates; forming an insulating layer on the moisture proof layer; forming an EMI (electromagnetic interference) shielding layer on the insulating layer; and forming a protection layer on the EMI shielding layer.

According to the present invention, by polishing the sealant and simplifying the configuration of function layers, the seam area in a PDP can be minimized, and therefore, continuity of screens can be stably ensured.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Hereinafter, a PDP and a method of fabricating the same, according to embodiments of the present invention, will be described in detail with reference to the accompanying drawings.

Figure 1:
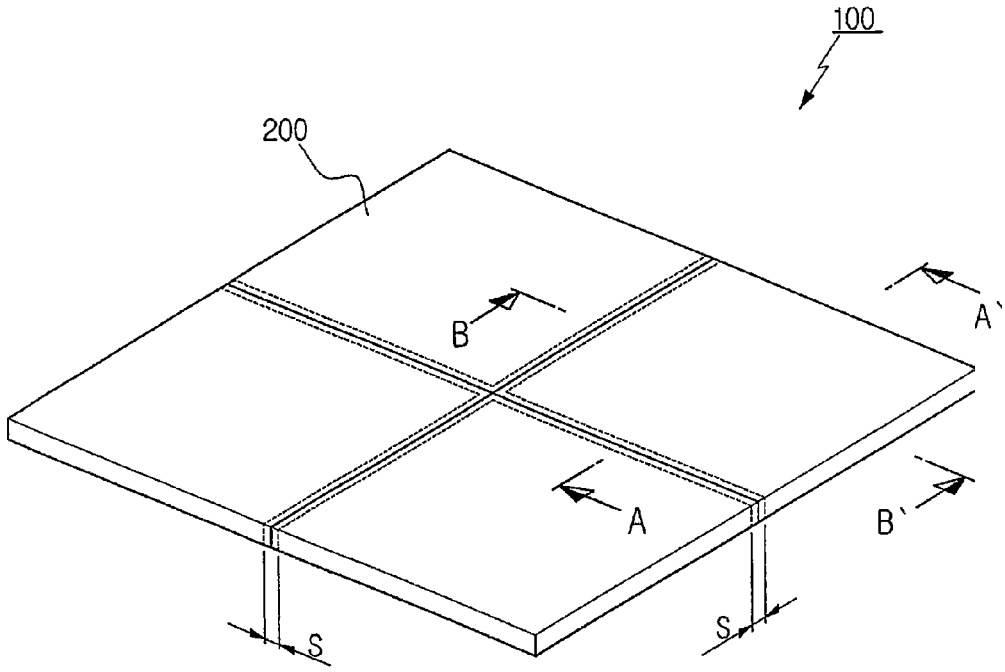
FIG. 1 is a perspective view of a PDP according to an embodiment of the present invention.
Figure 2:
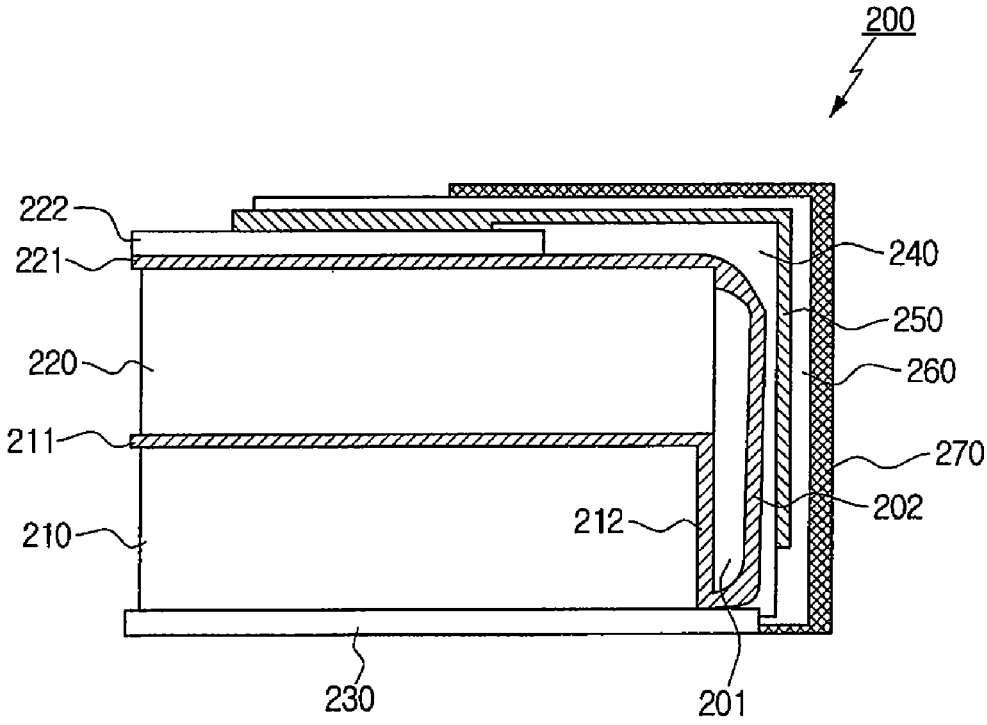
FIG. 2 is a cross-sectional view of a PDP taken along line A-A' of FIG. 1.
Figure 3:
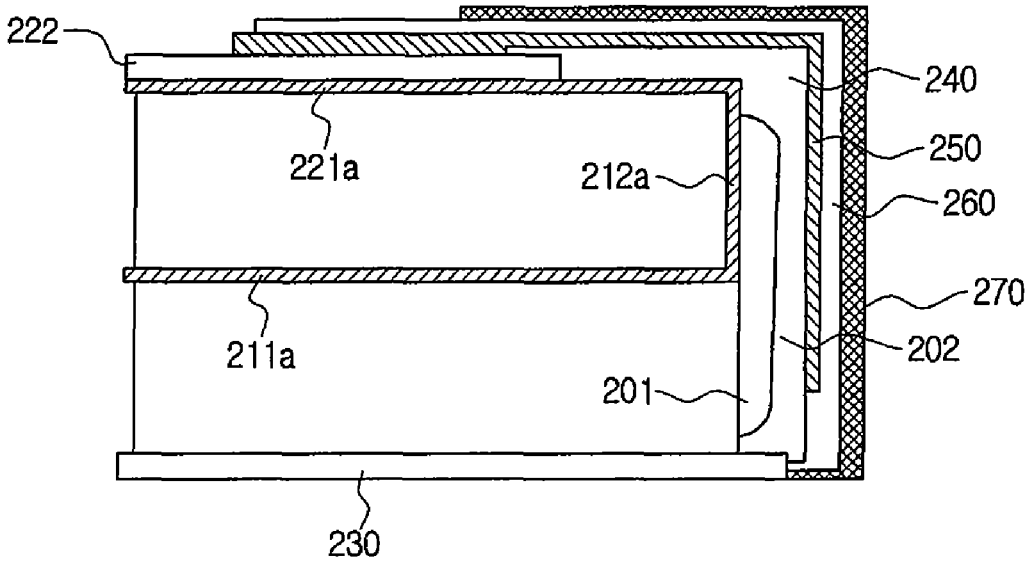
FIG. 3 is a cross-sectional view of a PDP taken along line B-B' of FIG. 1.

FIG. 1 is a perspective view of a PDP according to an embodiment of the present invention, and FIGS. 2 and 3 are cross-sectional views of a PDP taken along lines A-A' and B-B' of FIG. 1, respectively.

As shown in FIG. 1, the PDP 100 according to an embodiment of the present invention is configured by assembling a plurality of unit PDPs 200. As the plurality of unit PDPs 200 are assembled, a seam area S exists at the joint portion of the unit PDPs.

The configuration of the unit PDP 200 will be described below. As shown in FIGS. 2 and 3, the unit PDP 200 basically has a configuration in which a front plate 210 and a rear substrate 220 are sequentially stacked and laminated together. Although not shown in these figures, through a preparation process, a scan electrode, a sustain electrode, a dielectric layer, a protection layer, and the like are formed on the front substrate 210, and an address electrode, a dielectric layer, a rib, a phosphor layer, and the like are formed on the rear substrate 220. In FIG. 2, an inner front electrode 211 is formed on the front substrate 210, and a first side front electrode 212 is formed on the side surface of the front substrate 210. The inner front electrode 211, an outer front electrode 221 and the first side front electrode 212 are electrodes having the same function as any one of the scan and sustain electrodes. An optical film 230 is further formed on the front surface of the front substrate 210.

For reference, an outer dielectric layer 222 may further be formed on the rear surface of the rear substrate 220.

A sealant 201 for isolating an inner space between the front and rear substrates 210 and 220 from an external environment is formed on side surfaces of the front and rear substrates 210 and 220. A second side front electrode 202 having the same function as the inner front electrode 211, the outer front electrode 221 and the first side front electrode 212 is formed on the sealant 201.

In the sate that the front and rear substrates 210 and 220 are assembled together, and the sealant 201 and the second side front electrode 202 are formed on the side surfaces of the front and rear substrates 210 and 220, functional layers are formed on the rear surface of the rear substrate 220 and the side surfaces of the front and rear substrates 210 and 220, so that the exposed outer front electrode 221 and the second side front electrode 202 are protected, and the stacked and laminated state of the front and rear substrates 210 and 220 is maintained stably, isolated from the external physical environment.

Specifically, the functional layers include a moisture proof layer 240, an insulating layer 250, an EMI shielding layer 260 and a protection layer 270. The moisture proof layer 240 is formed on the rear surface of the rear substrate 220 and the side surfaces of the front and rear substrates 210 and 220. The moisture proof layer 240 functions to protect the outer front electrode 221 and the second side front electrode 202, in other words, the sustain, bus and address electrodes, to prevent the second side front electrode 202 from migrating due to moisture absorption, and to prevent the second side front electrode 202 and the EMI shielding layer 260 from being electrically shorted. The moisture proof layer 240 may be formed of any one of acryl, urethane and epoxy, or a combination thereof.

The insulating layer 250 is formed on the moisture proof layer 240 to prevent the outer front electrode 221 and the second side front electrode 202 from being electrically shorted.

The EMI shielding layer 260 is formed on the insulating layer 250 so as to shield electromagnetic interference generated from the rear surface of the rear substrate 220 and the side surfaces of the front and rear substrates 210 and 220. Preferably, the EMI shielding layer 260 is formed of a metallic material with high electric conductivity. The material used in the EMI shielding layer 260 may include any one of Ag, Cu, Pt, Au and AI, or a combination thereof.

The protection layer 270 is formed on the EMI shielding layer 260, and basically functions to protect the unit PDP including the front and rear substrates 210 and 220 against external physical impact and to isolate the EMI shielding layer 260 from the outside electrically. The protection layer 270 may be formed of a material the same as or different from the moisture proof layer 240. Specifically, the protection layer 270 may be formed of any one of acryl, urethane and epoxy, or a combination thereof.

In the aforementioned configuration of FIG. 2, the inner front electrode 211 formed on the front substrate 210, i.e., the scan and the sustain electrodes, is drawn toward the outside. FIG. 3 is a cross-sectional view illustrating an inner rear electrode 211*a* formed on the rear substrate 220, i.e., an address electrode drawn toward the outside, in which the inner rear electrode 211*a* is drawn toward the outside through a side rear electrode 212*a* formed on the side of the rear substrate 220 and an outer rear electrode 221*a*, unlike the inner front electrode 211. The configuration of FIG. 3 is the same as that of FIG. 2, except that the inner rear electrode 211*a* is drawn toward the outside through the side rear electrode 212*a* and the outer rear electrode 221*a*. Therefore, detailed description will be omitted. For reference, the side electrode formed on the side surfaces of the front and rear substrates is subdivided into the first and second side front electrodes and the side rear electrode shown in FIG. 3.

Figure 4:
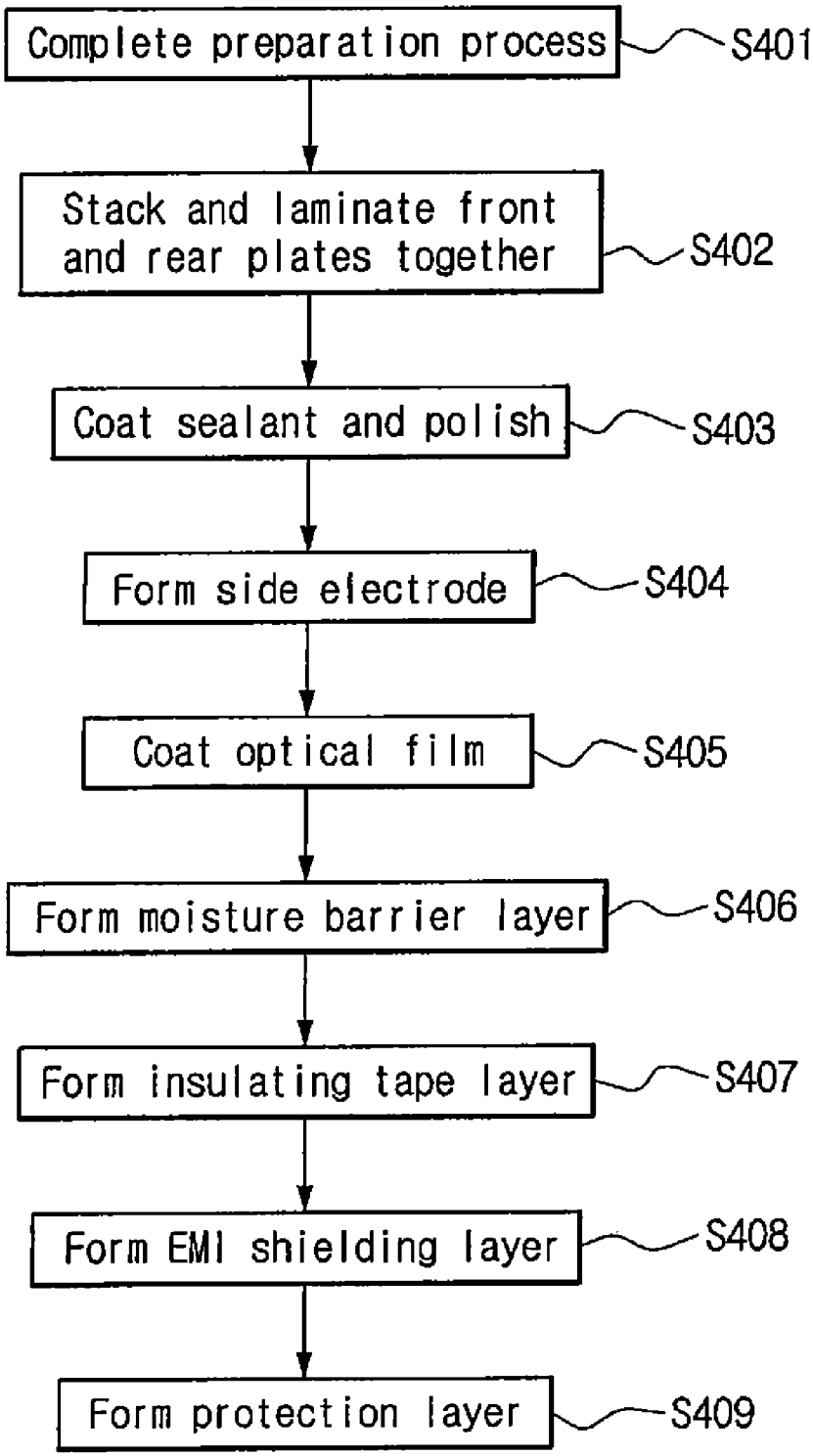
FIG. 4 is a flowchart illustrating the process of fabricating a PDP according to an embodiment of the present invention.

The configuration of the PDP according to the embodiment of the present invention has been described above. Hereinafter, a method of fabricating a PDP according to an embodiment of the present invention will be described. FIG. 4 is a flowchart illustrating the process of fabricating a PDP according to an embodiment of the present invention, and FIGS. 5 to 11 are cross-sectional views illustrating the method of fabricating a PDP according to the embodiment of the present invention, which shows a method of forming front electrodes (scan and sustain electrodes).

Figure 5:
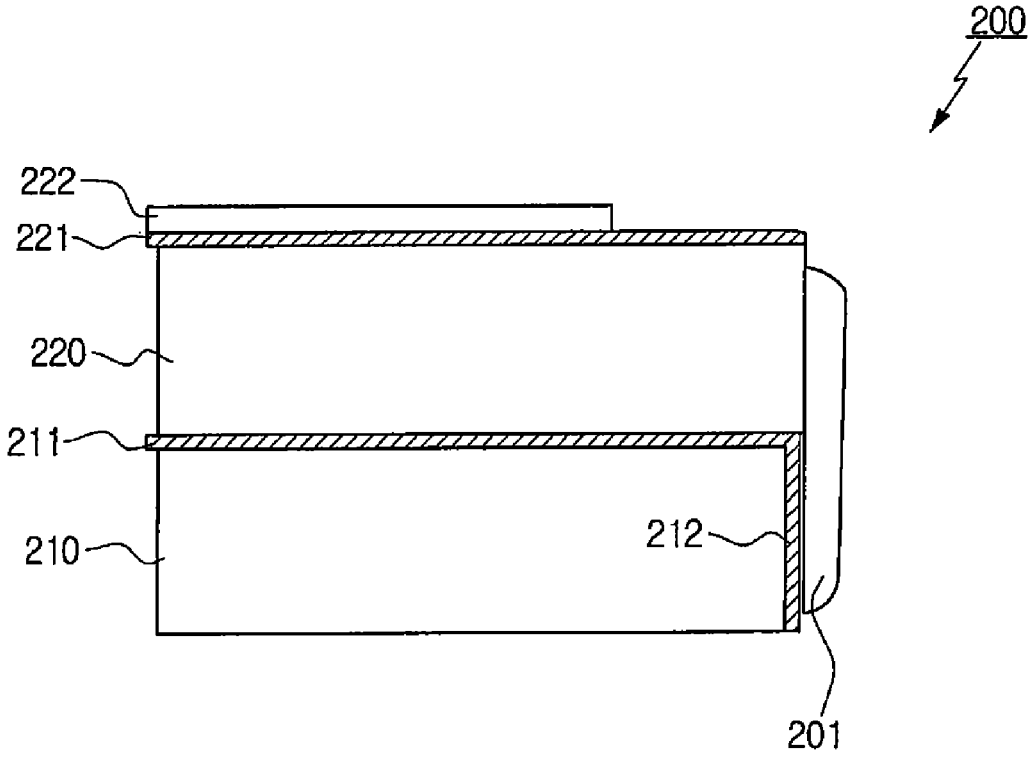
FIGS. 5 to 11 are cross-sectional views illustrating the method of fabricating a PDP according to an embodiment of the present invention.
Figure 6:
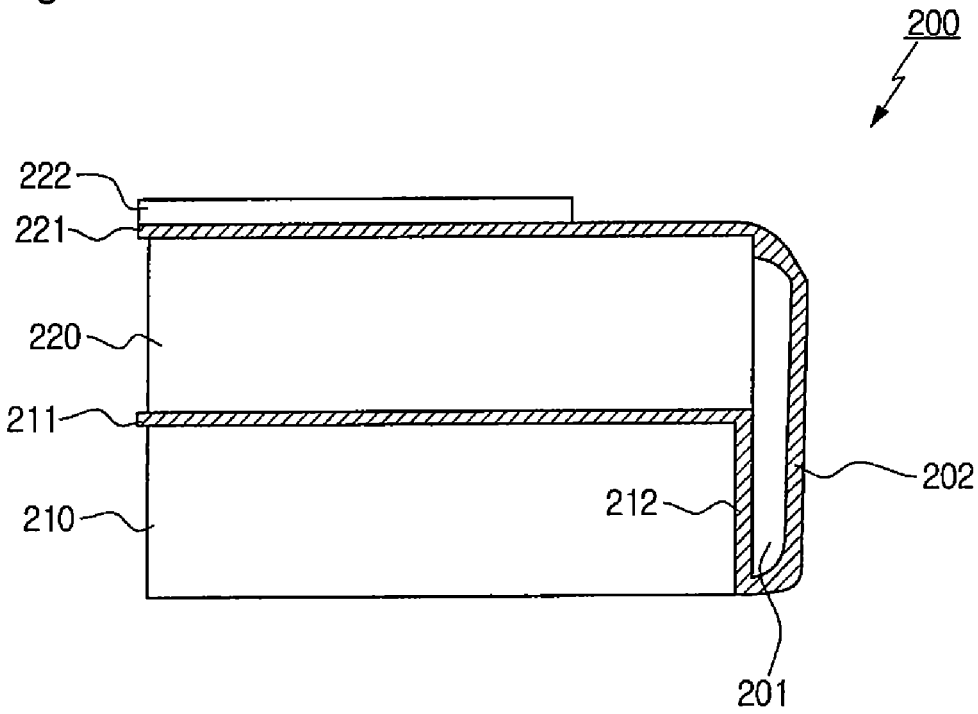
Figure 7:
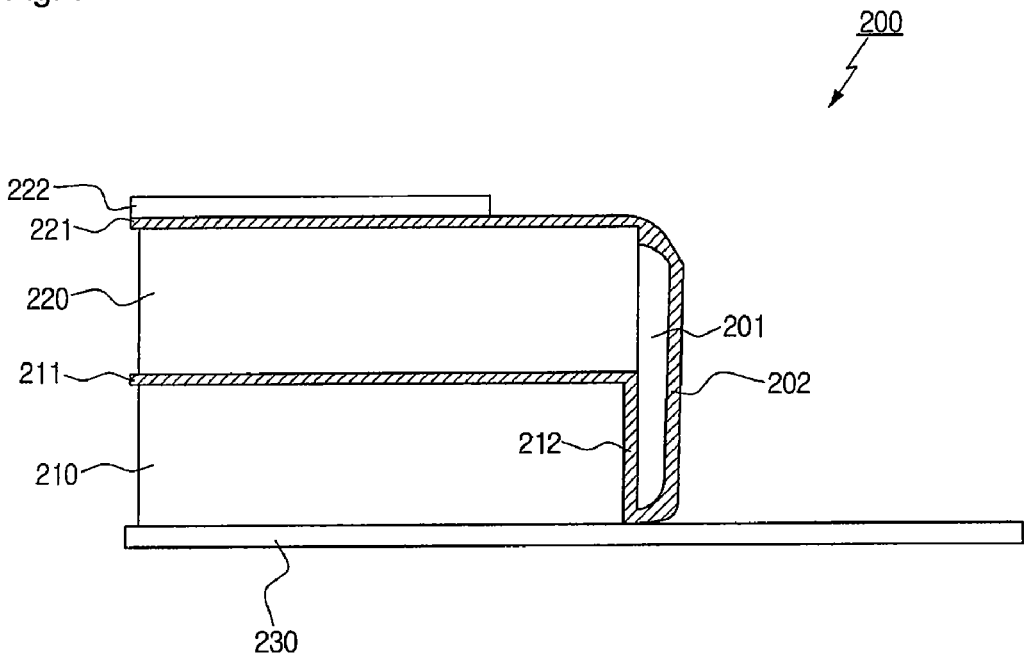
Figure 8:
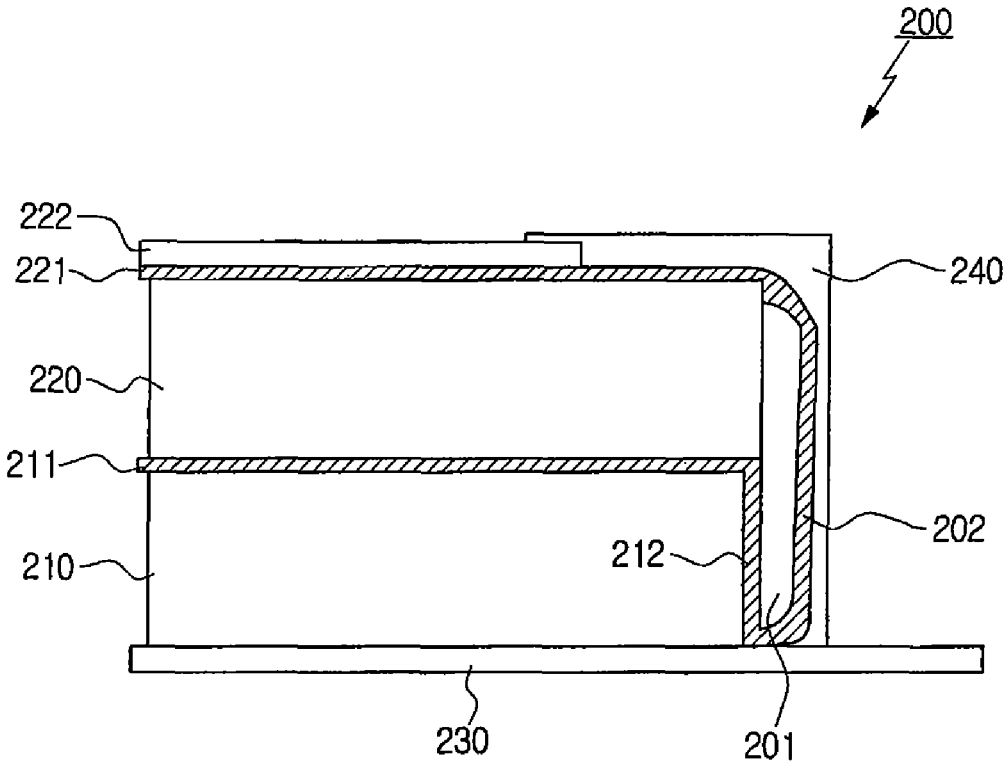
Figure 9:
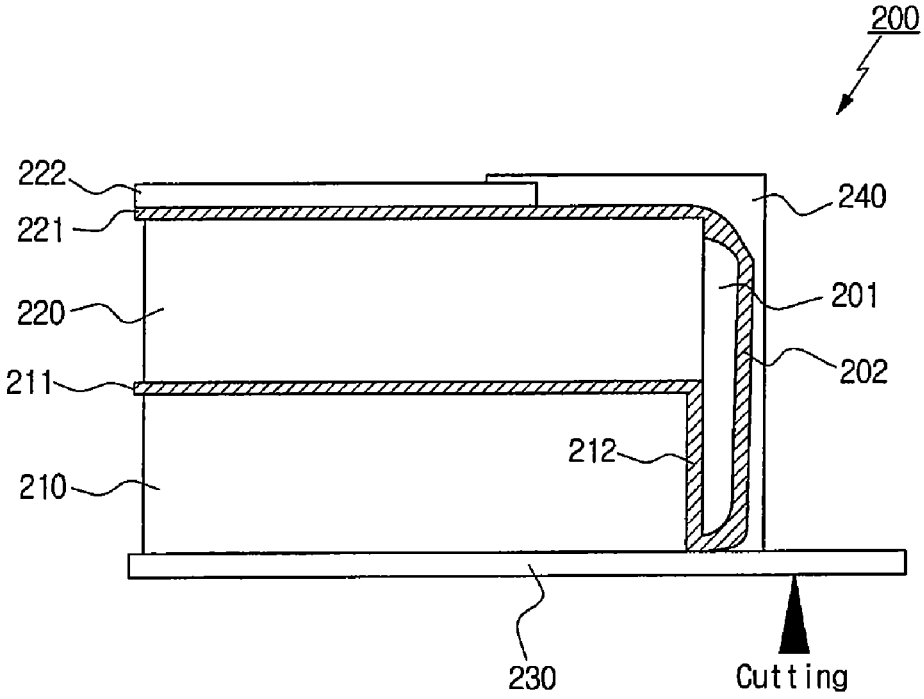
Figure 10:
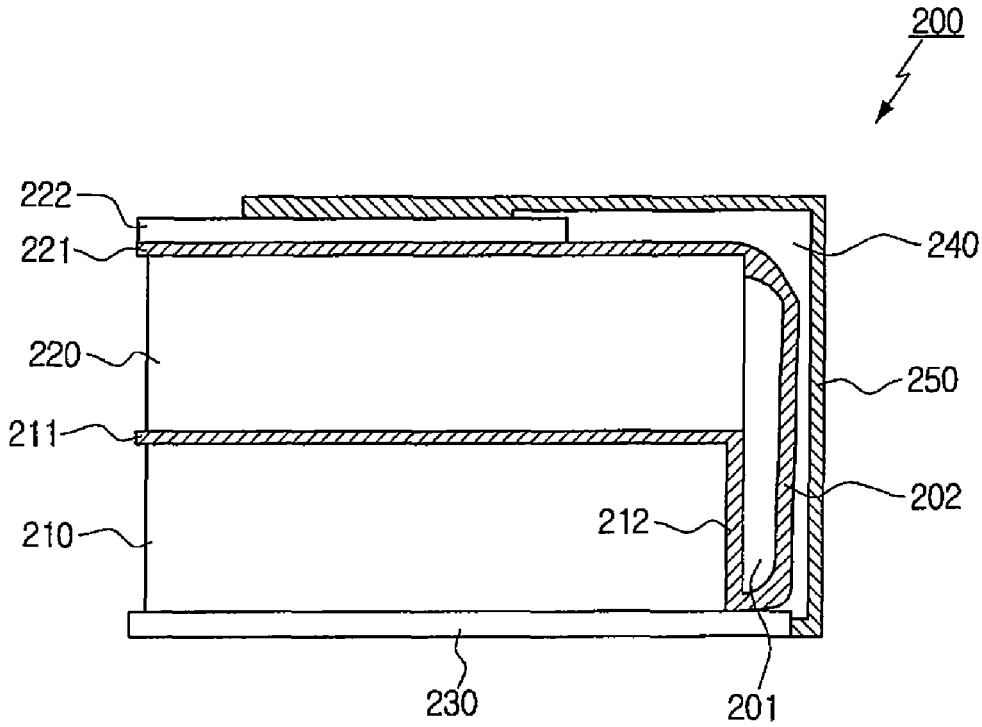
Figure 11:
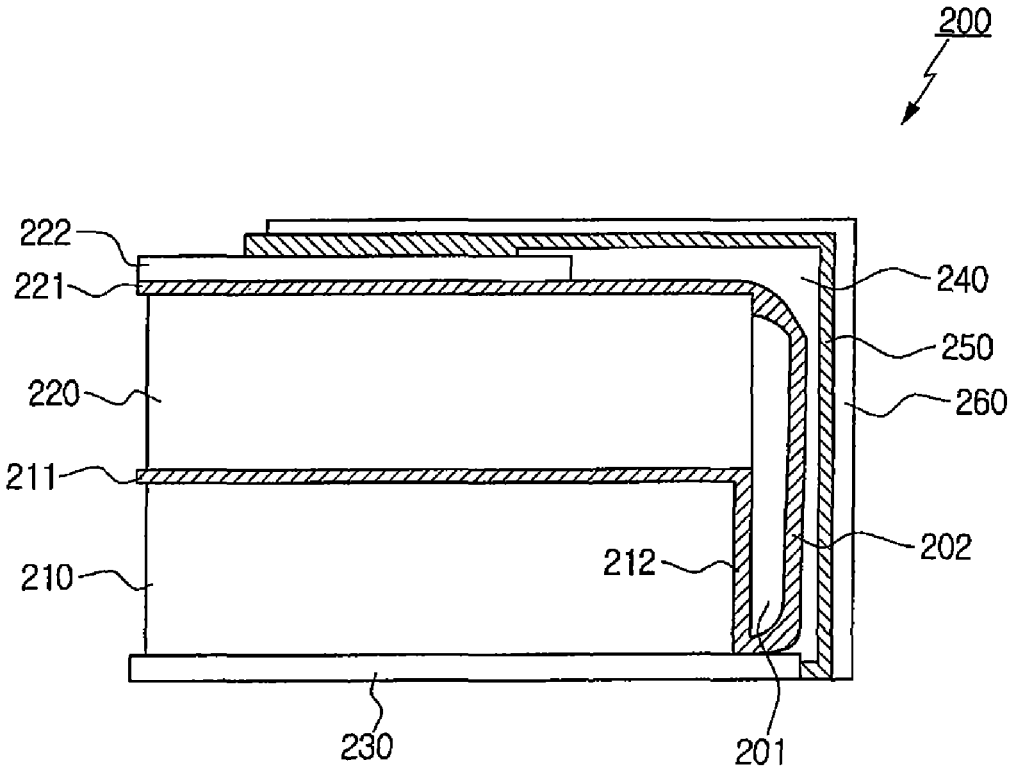

As shown in FIGS. 4 and 5, after the preparation process has been completed (S401), front and rear substrates 210 and 220 are stacked and laminated together (S402), and a sealant 201 is formed on the side surfaces of the front and rear substrates 210 and 220. The front and rear substrates 210 and 220 are sealed together by the sealant. Here, as described above in the preparation process, a scan electrode, a sustain electrode, a dielectric layer, a protection layer, and the like are formed on the front substrate 210. In FIG. 5, an inner front electrode 211 is formed on the front substrate 210, and a first side front electrode 212 is formed on the side surface of the front substrate 210. The inner front electrode 211, an outer front electrode 221 and the first side front electrode 212 are electrodes having the same function as any one of the scan and sustain electrodes. For reference, an outer dielectric layer 222 may be further formed on the rear surface of the rear substrate 220.

The sealant 201 is coated on the side surfaces of the front and rear substrate 210 and 220, and then a process of polishing the sealant is performed (S403). Through the process of polishing the sealant 201, the thickness of the sealant 201 is decreased. Consequently, the seam area can be reduced.

After the process of polishing the sealant 201 has been completed, a second side front electrode 202 is formed on the polished sealant 201 (S404). The second side front electrode 202 is the same electrode as the inner front electrode 211, the outer front electrode 221 and the first side front electrode 212 as described above. The second side front electrode 202 is any one of the scan and sustain electrodes.

Thereafter, an optical film 230 is coated on the entire surface of the front substrate 210 (S405). Subsequently, a moisture proof layer 240 is formed on the rear surface of the rear substrate 220 and the side surfaces of the front and rear substrates 210 and 220 (S406). Specifically, the moisture proof layer 240 may be formed by coating a material for the moisture proof layer 240 using any one of a dipping method, a dispensing method, a spraying method, or a combination thereof, and then curing the material using any one of ultraviolet radiation, thermal treatment, natural drying, or a combination thereof. Here, the material for the moisture proof layer 240 is any one of acryl, urethane and epoxy.

The moisture proof layer 240 formed using such a method functions to protect the outer front electrode 221 and the second side front electrode 202, in other words, the sustain, bus and address electrodes, to prevent the second side front electrode 202 and the outer front electrode 221 from migrating due to moisture absorption, and to prevent an EMI shielding layer 260 from being electrically shorted with the electrodes.

Subsequently, the optical film 230 coated on the entire surface of the front substrate 210 is cut to have a proper size, and an insulating layer 250 is then formed on the moisture proof layer 240 (S407). The insulating layer 250 functions to prevent the outer front electrode 221 and second side front electrode 202 from being electrically shorted with the EMI shielding layer 260.

Thereafter, the EMI shielding layer 260 is formed on the insulating layer 250 (S408). The EMI shielding layer 260 functions to shield electromagnetic interference generated from the rear surface of the rear substrate 220 and the side surfaces of the front and rear substrates 210 and 220. Preferably, the EMI shielding layer 260 is formed of a material which has high electric conductivity and is does not chemically react with other components. Specifically, the material may include any one of Ag, Cu, Pt, Au, Al, Pb, Cr, Ni, or a combination thereof.

The EMI shielding layer 260 may be formed by coating an EMI shielding material using any one of a dipping method, a dispensing method, a spraying method, a brushing method, or a combination thereof, and then curing the EMI shielding material using any one of ultraviolet radiation, thermal treatment, natural drying, or a combination thereof. Here, the EMI shielding layer 260 is to be laminated with the optical film 230, and electromagnetic waves collected from the optical film 230 are eliminated through an external ground connected to the rear surface of the rear substrate 220 via the EMI shielding layer 260.

Finally, a protection layer 270 is finally formed on the EMI shielding layer (S409). The protection layer 270 may be formed of the same material as that constituting the moisture proof layer 240, and the method of forming the moisture proof layer 240 may be employed to form the protection layer 270. That is, the protection layer may be formed by coating an EMI shielding material using any one of a dipping method, a dispensing method, a spraying method, a brushing method, or a combination thereof, and then curing the EMI shielding material using any one of ultraviolet radiation, thermal treatment, natural drying, or a combination thereof.

As described above, the method of fabricating a PDP has been described with respect to the drawing of front electrodes, i.e., scan and sustain electrodes, and the configuration of functional layers. A description about the method of fabricating a PDP with respect to the drawing of the rear electrode, i.e., an address electrode, and the configuration of functional layers will be omitted. It because the drawing structure of the rear substrate is only slightly different from that of the front substrate, but the rear substrate electrode is the same as the front electrode in forming the functional layers.

The present invention relates to a PDP and a method of fabricating the same, and more particularly, to a PDP wherein a seam area is minimized, so that continuity of screens can be stably ensured, and a method of fabricating the same.

What is claimed is:

1. A multi plasma display panel (PDP) formed by assembling a plurality of unit PDPs, wherein each of the unit PDPs comprises:

front and rear substrates sequentially stacked and laminated together;

a sealant formed on the side surfaces of the front and rear substrates;

side electrodes formed on the sealant; and functional layers formed on the rear surface of the rear substrate and the side surfaces of the front and rear substrates, wherein the functional layers comprise:

a moisture proof layer formed on the rear surface of the rear substrate and the side surfaces of the front and rear substrates;

an insulating layer formed on the moisture proof layer;

an electromagnetic interference (EMI) shielding layer formed on the insulating layer; and a protection layer formed on the EMI shielding layer, wherein the moisture proof layer, the insulating layer, the electromagnetic interference (EMI) shielding layer, and the protection layer of the claimed panel are sequentially disposed.

2. The multi PDP as claimed in claim 1, wherein the EMI shielding layer is formed of any one of Ag, Cu, Pt, Au, Al, Pb, Cr, Ni, and a combination thereof.

3. The multi PDP as claimed in claim 1, wherein the moisture proof layer and the protection layer are formed of any one of acryl, urethane, epoxy, and a combination thereof.

* * * * *